United States Patent [19]

Engel

[11] Patent Number: 4,802,653

[45] Date of Patent: Feb. 7, 1989

[54] SCISSORS JACK

[75] Inventor: Darryl L. Engel, Laotto, Ind.

[73] Assignee: Universal Tool & Stamping Co., Inc., Butler, Ind.

[21] Appl. No.: 121,165

[22] Filed: Nov. 16, 1987

[51] Int. Cl.[4] ..... B66F 3/08

[52] U.S. Cl. ..... 254/126

[58] Field of Search ..... 254/122, 126

[56] References Cited

U.S. PATENT DOCUMENTS 3,645,501 2/1972 Musgrove ..... 254/126

4,583,713 4/1986 Fukura et al. ..... 254/126

FOREIGN PATENT DOCUMENTS 2145392 3/1985 United Kingdom ..... 254/126

*Primary Examiner*—Robert C. Watson

[57] ABSTRACT

A scissors jack which has channel link members formed with slots which can be placed over rivets in the jack which have previously been staked in the base or the cap without the channel or link members. The invention relates in an improved jack which can be assembled quicker and easier since holes do not have to be formed in the channel members and the rivets inserted through such holes. The slots formed in the links are such that the links can be placed on the rivets and then rotated and then the free ends of the links are connected together with pivot pins and trunions during which time the links are rotated which locks the links to the rivets in the base and the cap so as to prevent the links from being withdrawn from the base or the cap.

1 Claim, 2 Drawing Sheets

FIG. 3
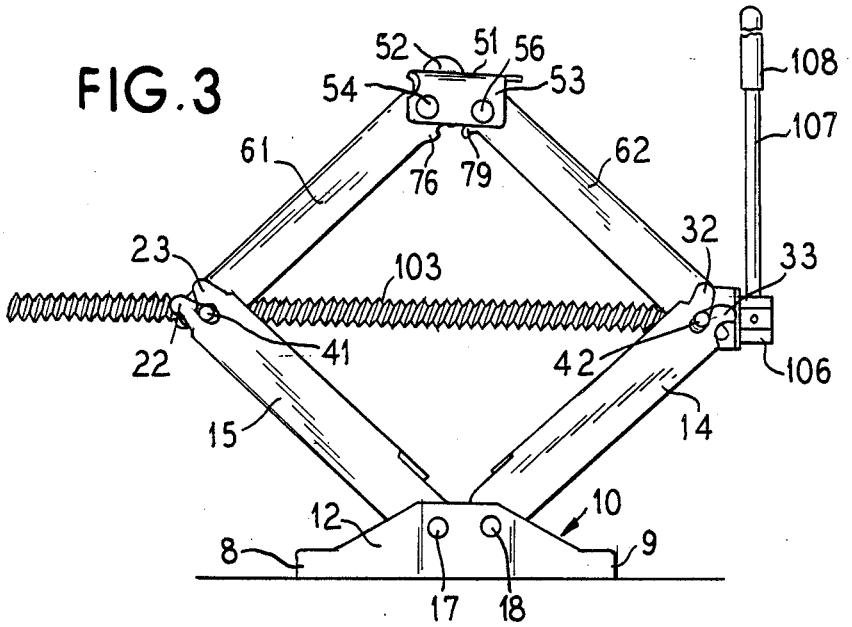
FIG. 2
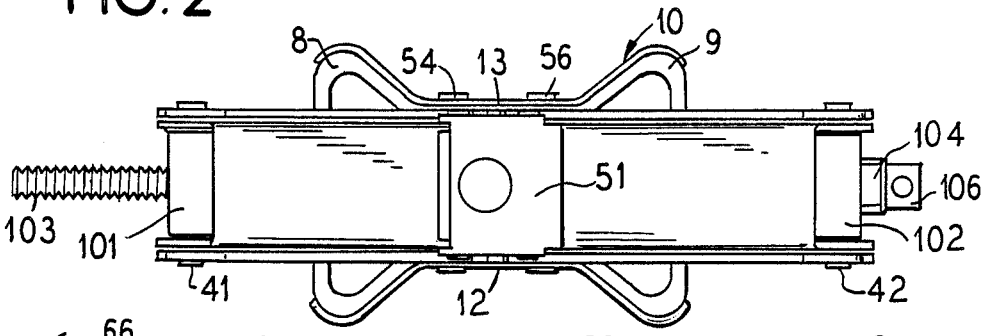
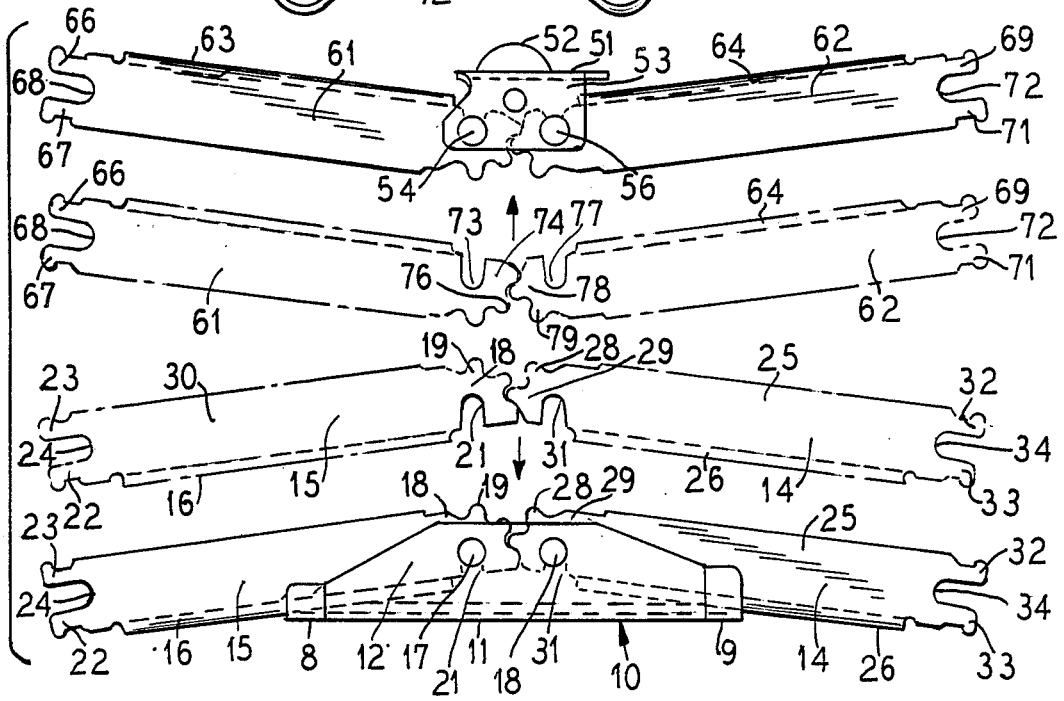
FIG. 1

SCISSORS JACK

CROSS-REFERENCES TO RELATED APPLICATIONS

This application is an improvement on application Ser. No. 087,798, filed Aug. 21, 1987 entitled "Jack Storage System and Apparatus".

BACKGROUND OF THE INVENTION

1. Field of the Invention

This invention relates in general to scissors jacks and in particular to a novel scissors jack which can be assembled in a simple manner.

2. Description of the Prior Art

Scissors jacks are riveted together by first inserting a rivet through the base or cap and channel or link members and then staking the rivet. This necessitates that all the holes are in line to insert the rivet. Such a structure is shown, for example, in the above-referenced copending application Ser. No. 087,798.

SUMMARY OF THE INVENTION

The present invention provides an improved scissors jack in which slots are formed in the channel or link members rather than holes as in the prior art and the rivets are inserted into the base or cap member and then staked and then the channel or link members are placed such that the slots in the links pass over the rivets after which the links are rotated relative to each other so as to lock the links to the jack. The free end of the links or channels are formed with slots into which a pin or trunion is inserted and such slots are then formed around the pivot pins or trunions so as to provide a completed assembly.

The pivoting of the channel or link members causes the open slots to be tipped away from each other so that the assembly cannot come apart and the completed jack assembly provides that the slots are tipped away from each other so that the completed jack assembly will never come apart.

It is an object of the present invention to provide a novel scissors jack which can be simply and inexpensively formed so as to provide an improved scissors jack.

Other objects, features and advantages of the invention will become readily apparent from the following description of certain preferred embodiments thereof taken in conjunction with the accompanying drawings although variations and modifications may be effected without departing from the spirit and scope of the novel concepts of the disclosure and in which:

BRIEF DESCRIPTION OF THE DRAWINGS

FIG. 1 is an exploded view showing the lower and upper links of the invention;

FIG. 2 is a top plan view of the assembled jack;

FIG. 3 is a side plan view of the assembled jack;

DESCRIPTION OF THE PREFERRED EMBODIMENTS

Figures 4, 5:
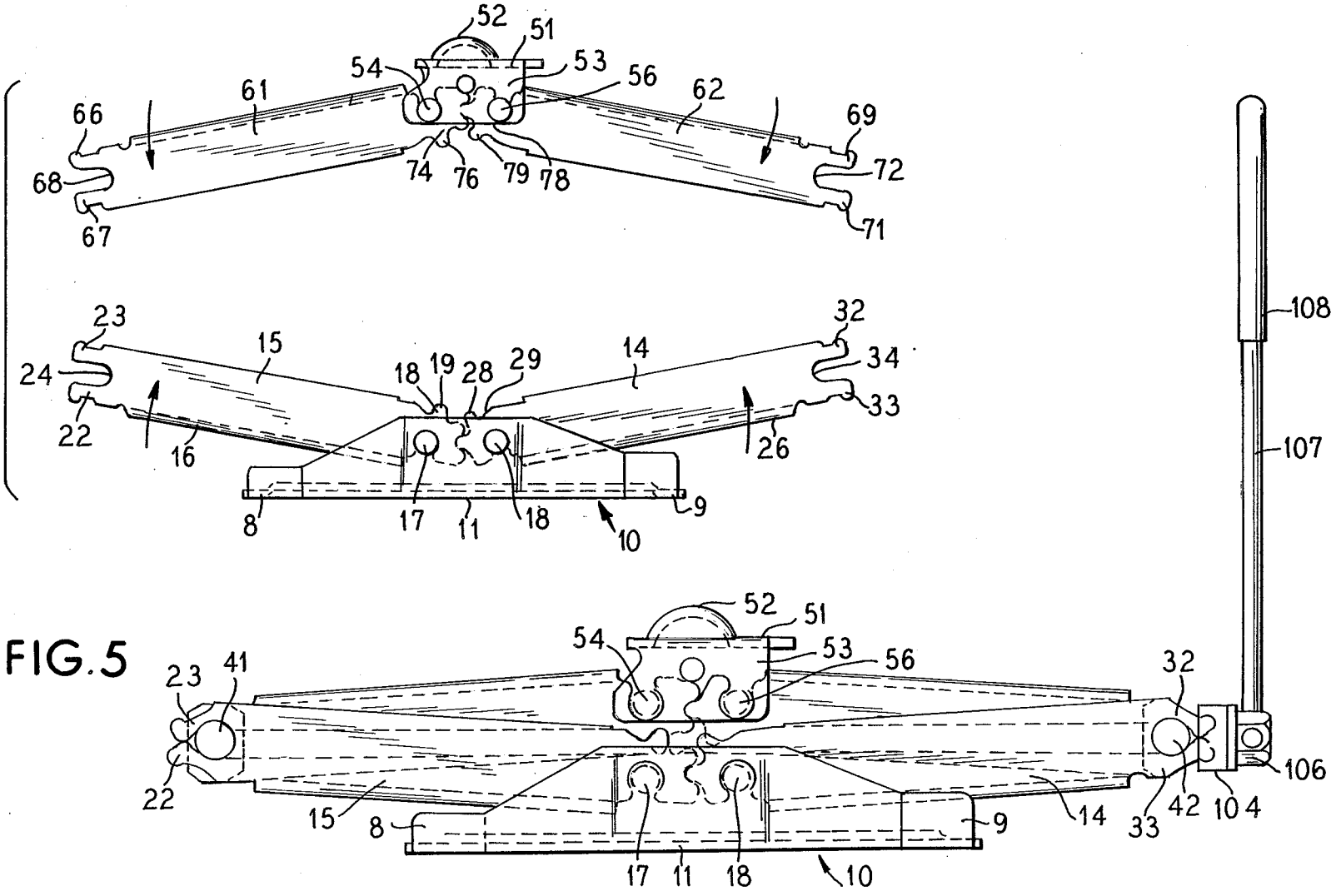
FIG. 4 is an exploded view showing the upper and lower links.
FIG. 5 is an assembled side plan view of the jack.

FIGS. 1–5 show the novel jack of the invention and the method of assembling it and reference may be made to copending application Ser. No. 087,798 which disclosure is hereby incorporated by reference so as to give the general concept of a scissors jack.

The present invention comprises an improved scissors jack which is formed with a base 10 that has a bottom 11 and upwardly extending sidewalls 12 and 13 and end feet 8 and 9. Rivets 17 and 18 are extended through openings formed in the sidewalls 12 and 13 and are staked so as to provide pivot pins for the lower links of the jack. After the pivot pins 17 and 18 have been staked in the base 10, a pair of lower links 14 and 15 are mounted thereon.

The lower link 15 is formed as a channel and has a base 16 and sidewalls 30. The outer ends of the sidewalls are formed with portions 22 and 23 between which is formed an outer slot 24. The inner portion 18 of the sidewalls of the channel 15 are formed with gear teeth 19. A slot 21 is formed in a lower portion relative to FIG. 1 of the channel 15. The channel 14 is formed with a base portion 26 and sidewalls 25 and has an outer end formed with a slot 34 between projections 32 and 33. The inner portion 29 of channel or link 14 is formed with gear teeth 28 and a slot 31 is formed in the lower portion of channel or link 14. A pair of upper links 61 and 62 are channel-shape. The link 61 is formed with a base 63 and has outer projections 66 and 67 between which is formed a slot 68. The inner portion 74 of the channel 61 is formed with gear teeth 76 and an upper slot 73 is formed in the portion 74. The link 62 is formed with a cross-member 64 and has outer projecting portions 69 and 71 between which is formed a slot 72. The inner portion 78 of link 62 is formed with teeth 79 and slot 77 is formed in the upper portion thereof as show in FIG. 1. The cap 51 is formed with an automobile engaging portion 52 which may be hemispherical-shaped and has sidewalls 53 between which extend rivets 54 and 56. The rivets 54 and 56 may be staked into the channel shaped sidewalls 53 of the member 51 before assembly of the links.

In assembly, the lower links 14 and 15 are placed end to end as shown in the lower portion of the exploded view of FIG. 1 such that the gear teeth 19 and 28 engage and such that the slots 21 and 31 are parallel to each other such that the links 14 and 15 can be moved downwardly such that the rivets 17 and 18 respectively move into the slots 21 and 31 as shown in the lower view of the exploded view of FIG. 1. It is noted for the slots 21 and 31 to be parallel to each other, it is necessary that the top surfaces of the links 14 and 15 make an angle greater than 180° which moves the slots 21 and 31 so that they are parallel to each other and can fit over the rivets 17 and 18. After the rivets 17 and 18 are received in the slots 21 and 31, the links 14 and 15 have their free ends pivoted upwardly which due to the interaction of the gear teeth 19 and 28 cause the slots to move to the position shown in FIG. 4 where the links 14 and 15 cannot be removed from the rivets 17 and 18.

During assembly, the upper links 61 and 62 are moved so that their surfaces 63 and 64 make an angle of less than 180° so that the slots 73 and 77 are parallel to each other and the rivets 74 and 76 of the cap member 51 can be received in the slots 73 and 77. After the rivets are in place in the slots 73 and 77, the links 62 and 61 are pivoted to the position illustrated in the upper portion of FIG. 4 so that the links are locked on the rivets 54 and 56.

The outer ends of the links 14, 15, 61 and 62 are connected together by pivot pins 41 and 42 upon which are respectively mounted trunions 101 and 102 as illustrated in FIG. 2, for example. The ends 22, 23, 32, 33, 66, 67 and 69 and 71 of the links 15, 14, 61 and 62 are compressed about the pivot pins 41 and 42 as shown in FIG. 3 to form a bearing for the pins.

The trunion 101 has a threaded opening through which a threaded shaft 103 can be received and the trunion 102 carries a thrust bearing which is attached to the threaded shaft 103. The end 106 of the shaft 103 is attached to a handle 107 which has a handle portion 108. The handle 107 allows the threaded shaft 103 to be rotated causing the thrust bearing 104 and the threaded collar mounted in the trunion 101 to raise and lower the jack in a conventional manner.

The novel structure of the jack by providing the slots 21, 31, 73 and 77 in the links 14, 15, 61 and 62 allows the jack to be rapidly and easily assembled and results in a substantial saving in time and labor.

Once the jack is assembled, the links cannot be removed from the rivets 17, 18 or 54 or 56 because the links never will move to the position shown in FIG. 1 because the outer ends of the links are held by pins 41 and 42.

Although the invention has been described with respect to preferred embodiments, it is not to be so limited as changes and modifications may be made therein which are within the full intended scope as defined by the appended claims.

I claim as my invention:

1. A scissor jack comprising, a base member formed with a channel, first and second pivot pins mounted in said base member and extending across said channel, first and second lower links each formed with gear teeth on their inner ends, a first slot formed in the lower surface of said first link, a second slot formed in the lower surface of said second link, said first and second pivot pins receivable into said first and second slots when said gear teeth are in mesh and the lower surfaces of said first and second links make an angle of less than 180 degrees, a cap formed with a channel, third and fourth pivot pins mounted in said cap and extending across said channel, third and fourth upper links each formed with intermeshing gear teeth on their inner ends and pivotally mounted on said third and fourth pivot pins, a fifth pivot pin pivotally connecting the outer ends of said first and third link, a sixth pivot pin pivotally connecting the outer ends of said second and fourth link and means for moving said fifth and sixth pivot pins toward and away from each other so as to raise and lower said jack, wherein a third slot is formed in the upper surface of said third link and a fourth slot is formed in the upper surface of said fourth link and said third and fourth pivot pins are receivable in said third and fourth links when said gear teeth are in mesh and the upper surface of said third and fourth links make an angle of less than 180 degrees, wherein the outer ends of said first, second, third and fourth links are formed with slots into which said fifth and sixth pivot pins are received and said slots at the outer ends of said first, second, third and fourth links are compressed around said fifth and sixth pivot pins, and wherein said means for moving said pivot pins includes a threaded collar mounted on said fifth pivot pin and a thrust bearing is mounted on said sixth pivot pin, and a threaded shaft with one and extending through said thrust bearing and the other end through said threaded collar and a handle for turning said threaded shaft.

* * * * *